United States Patent [19]

Rogers, Jr.

[11] Patent Number: 4,531,778

[45] Date of Patent: Jul. 30, 1985

[54] RECLINER CHAIR INCORPORATING LINKAGE AND TRACK SYSTEMS

[75] Inventor: Walter C. Rogers, Jr., Denton, N.C.

[73] Assignee: Parma Corporation, Denton, N.C.

[21] Appl. No.: 426,707

[22] Filed: Sep. 29, 1982

[51] Int. Cl.[3] ..... A47C 1/02

[52] U.S. Cl. ..... 297/85; 297/318; 297/322

[58] Field of Search ..... 297/85, 84, 89, 86, 297/83, 88, 68, 69, 340, 341, 342, 346, 316, 322, 318

[56] References Cited

U.S. PATENT DOCUMENTS

| | | | |
|---|---|---|---|
| 3,874,724 | 4/1975 | Ré297 | 88/ |
| 4,071,275 | 1/1978 | Rogers, Jr. | 297/85 |
| 4,077,663 | 3/1978 | Cyrowicz et al. | 297/83 |
| 4,099,776 | 7/1978 | Crum et al. | 297/68 |
| 4,108,491 | 8/1978 | Rogers, Jr. | 297/85 |
| 4,153,292 | 5/1979 | White et al. | 297/83 |
| 4,195,878 | 4/1980 | Cyrowicz et al. | 297/83 |
| 4,202,580 | 5/1980 | Johnson | 297/84 |
| 4,350,387 | 9/1982 | Rogers, Jr. | 297/85 |

*Primary Examiner*—William E. Lyddane
*Assistant Examiner*—Mark W. Binder
*Attorney, Agent, or Firm*—William E. Mouzavires

[57] ABSTRACT

A handle-operated, wall-avoiding, three-way recliner utilizes a track system for moving the chair from the TV position to the fully reclined position. However, in contrast to conventional "track recliners", the track does not come into play until the chair has been moved to the TV position through means of a linkage system. Such movement is preferably initiated by a handle operatively connected to the footrest linkage which is biased closed by a yieldable spring mechanism.

39 Claims, 8 Drawing Figures

RECLINER CHAIR INCORPORATING LINKAGE AND TRACK SYSTEMS

BACKGROUND OF INVENTION

It is of course well known in the prior art of recliner chairs to utilize various linkage systems for mounting and operating the various parts of the chair for movement between the upright or closed position, the TV position (wherein the footrest is extended) and the fully reclined position beyond the TV position. It is also well known to utilize a track system to mount and obtain movement of the chair between the upright, TV and fully reclined position. Although the use of a track system in a recliner chair provides the advantages of good lateral stability in the chair while in some cases requiring the use of lesser links or parts; track systems of the prior art also have some disadvantages owing to the fact that the rollers sometime bind in the tracks. Other disadvantages are described in my prior U.S. Pat. No. 4,071,275, which may also be referred to for definition of various terms which are used in this art and which are used herein.

Examples of prior art recliners utilizing track systems as described above appear in U.S. patents to Frank M. Ré U.S. Pat. Nos. 3,874,724, 3,941,417, 3,958,827; and U.S. Pat. No. 4,077,663 Cycowicz et al. The track systems of the recliner chairs of these patents allow the chair wall-avoiding action when moved into reclining positions. Wall-avoiding action is of course also achieved in other recliner chairs which rely solely on linkage systems rather than track systems, such recliner chairs being exemplified in my prior U.S. Pat. Nos. 4,071,275, 4,908,491, 4,350,387 and 4,350,386.

OBJECTS OF THE PRESENT INVENTION

It is an object of the present invention to provide a novel recliner that advantageously utilizes a track system for achieving certain movement of the chair but which minimizes the disadvantages heretofore associated with track system recliners.

Another object of the present invention is to provide a novel recliner chair utilizing combined linkage and track systems with their attendant advantages for mounting and operating various parts of the chair. Included herein is such a recliner chair which utilizes a linkage system for moving the chair to TV position and a track system for moving the chair beyond the TV position into advanced reclining positions including the fully reclined position.

Another object of the present invention is to provide a recliner chair as described above and which is furthermore a three-way, wall-avoiding, handle-operated recliner.

A further object of the present invention is to provide a recliner chair as described above but that also possesses a high degree of stability and yet allows the chair to be made with a relatively minimum number of linkage parts. Included herein is such a recliner chair that may be made to accomodate a T-cushion on its seat and other present-day styling requirements.

SUMMARY OF INVENTION

In summary, a recliner chair embodying the present invention includes: a base having tracks, a seat, a trolley mounted in the tracks, a linkage system mounting the seat to the trolley, a backrest linkage mounting the backrest to the seat, a footrest including a footrest linkage mounted to the seat, an actuating means, which in this specific embodiment, may include a handle for actuating the chair to TV position. A spring-biasing mechanism urges the footrest to the closed, generally upright position, and the spring-biasing mechanism is overcome when the footrest is moved to TV position.

In order to move the chair into advanced reclining positions beyond TV position, back pressure is exerted on the backrest which, through means of a thrust linkage causes the seat and trolley to move as a unit at an upward incline along the tracks. The chair is returned to TV position by removing pressure from the backrest which causes the trolley and the seat unit to move downwardly along the tracks by gravity. From the TV position, the chair is closed by the occupant exerting leg pressure on the footrest to fold the same.

In the closed generally upright position of the chair, the thrust linkage serves to prevent movement of the backrest relative to the seat. However, once the chair moves to TV position, the thrust linkage is oriented such that the backrest may be moved relative to the seat as the chair is moved into advanced reclining positions beyond the TV position.

DRAWINGS

Other objects and advantages of the present invention will appear below from the following more detailed description taken in conjunction with the attached drawings in which.

DETAILED DESCRIPTION

Figure 1:
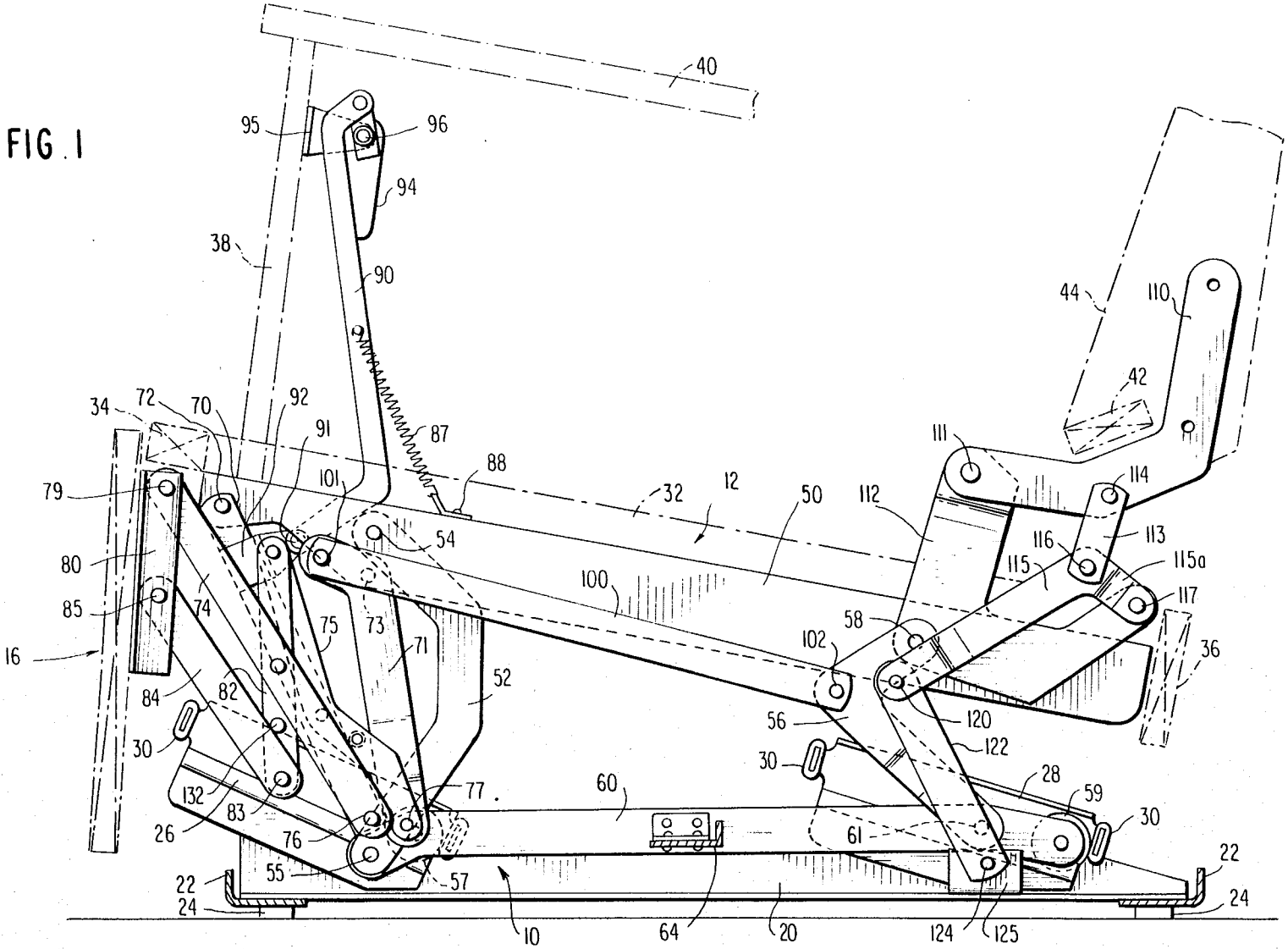
FIG. 1 is a side elevational view of a recliner chair constituting a first preferred embodiment of the invention, with the chair shown in the upright closed position as seen from the inside looking toward the right-hand side of the chair, and with some portions shown in phantom lines and other portions removed for clarity.
Figure 2:
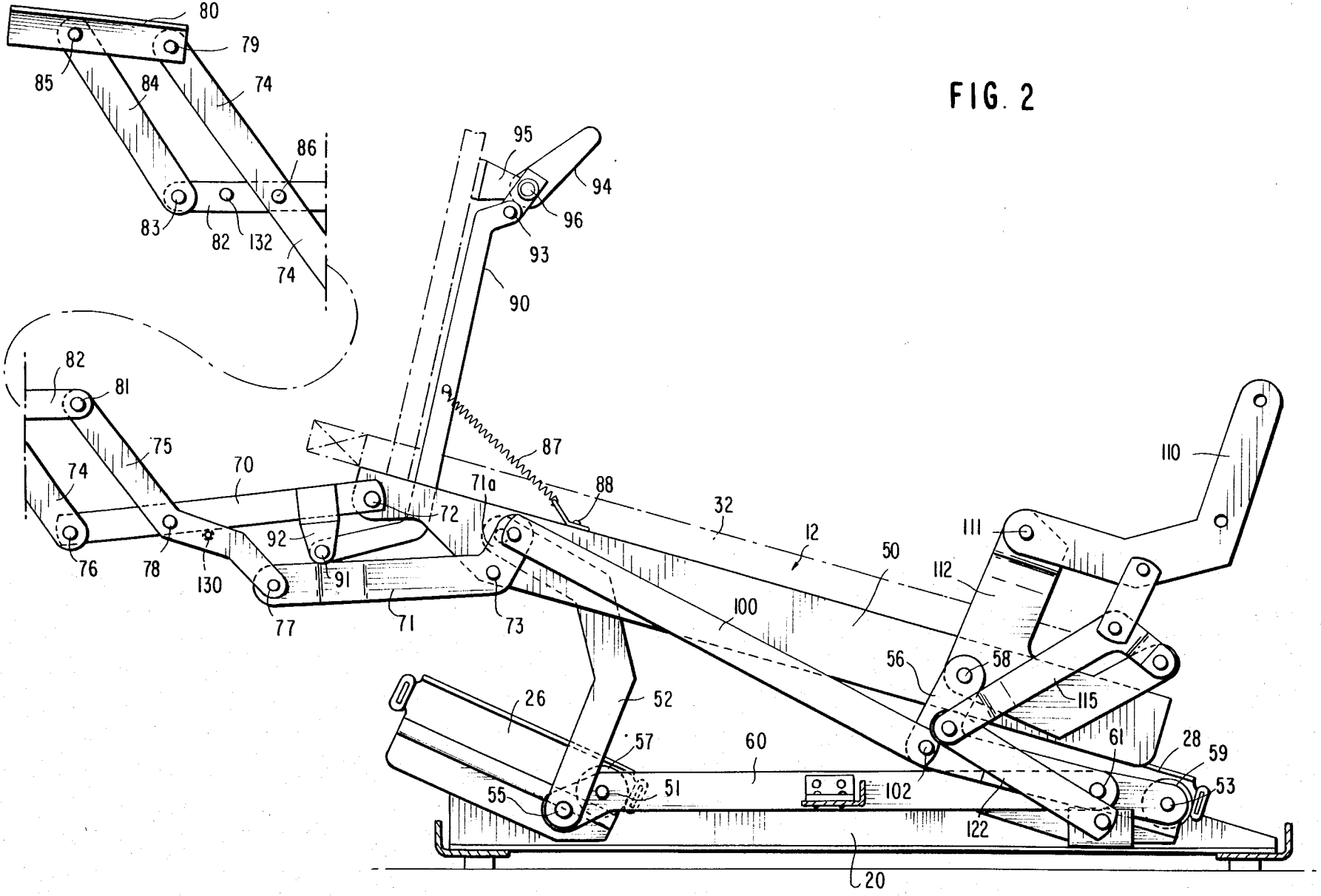
FIG. 2 is a view generally similar to FIG. 1, except the chair is shown in the TV position.
Figure 3:
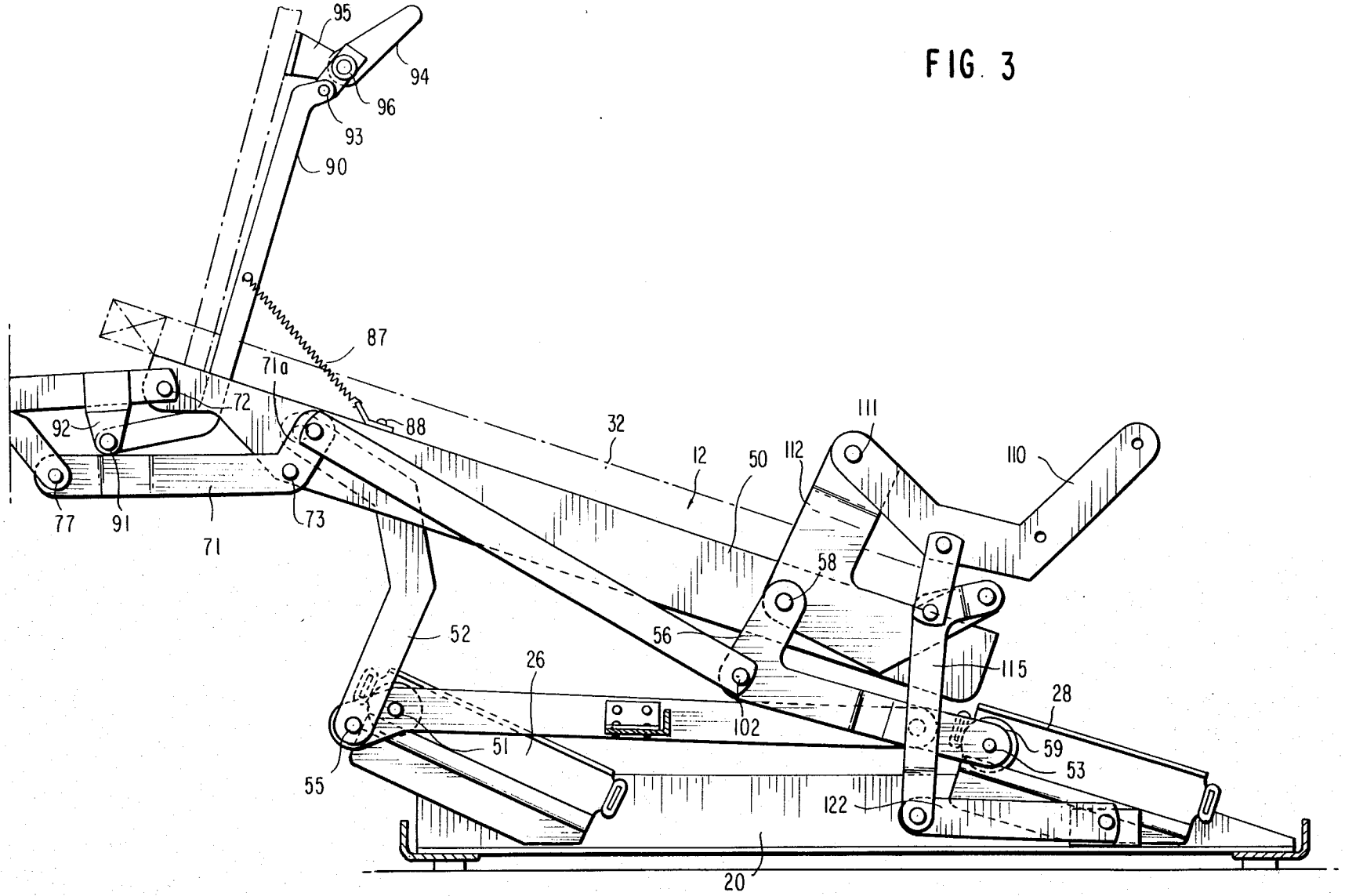
FIG. 3 is a view generally similar to FIG. 2 except the chair is shown in the fully reclined position.
Figure 3A:
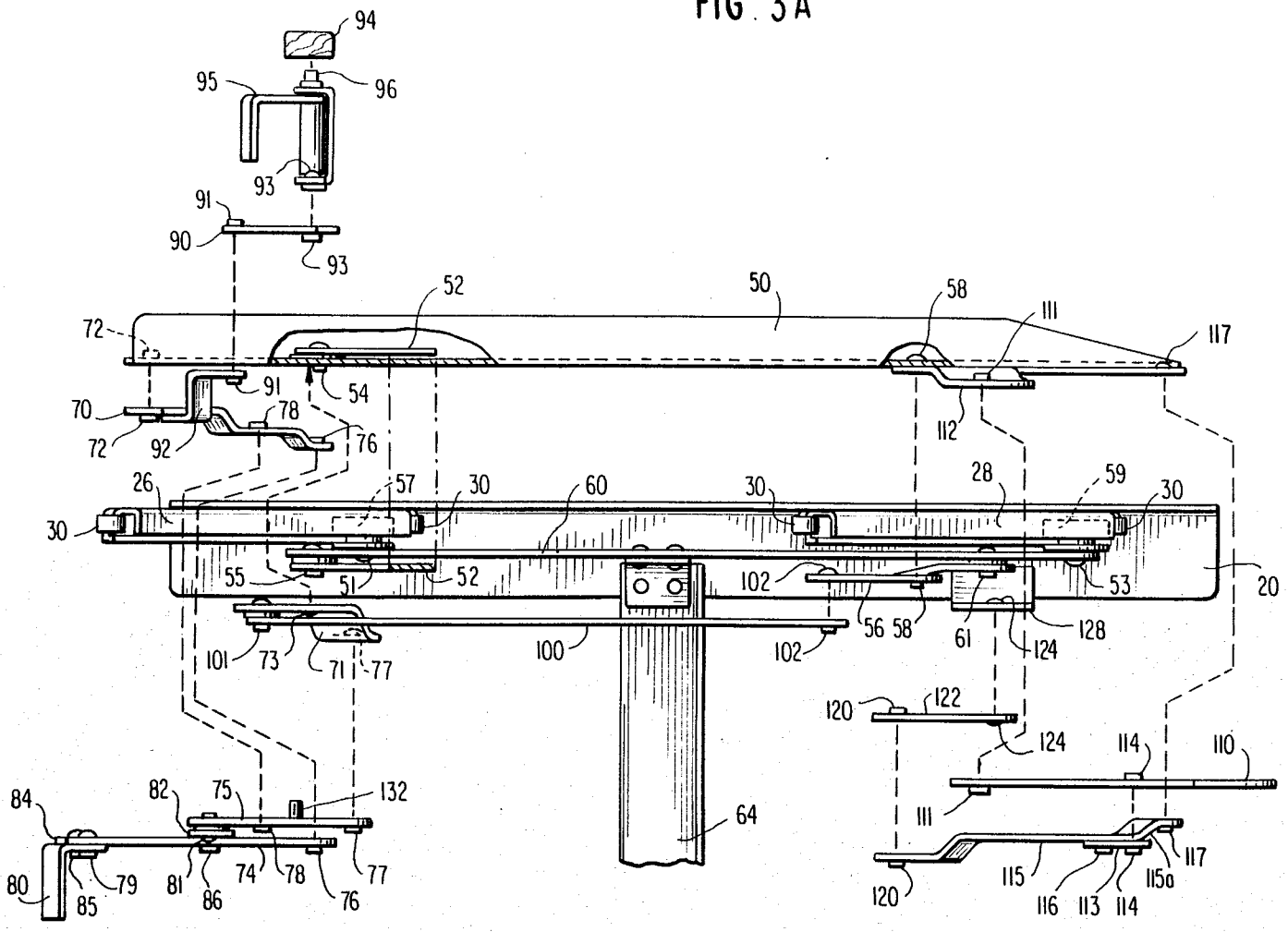
FIG. 3A is an exploded plan view of the chair when in the closed position and with certain parts removed.

Referring now to the drawings in detail, there is illustrated in FIGS. 1 to 3, a recliner chair constituting a first preferred embodiment of the invention. Basic parts of this chair include a base 10, seat 12, backrest 14 and footrest 16. Base 10 may have any suitable construction such as parallel metallic, flanged side rails 20 (one shown in FIG. 1) extending in the forward-rearward direction of the chair; and flanged metallic cross pieces 22 fixed to side rails 20 to form a rectangular framework, with glides 24 fixed to the undersides at the corners of the framework. On base 10 on the opposite sides of the front and rear sections thereof, are two pairs of tracks 26 and 28 respectively for mounting the seat 12 to the base as will be described in detail below. Each of tracks 26, 28 is formed from U-shaped steel channels fixed to the base in any suitable manner with the tracks extending at a forward and upward incline as shown in FIG. 1. Across the opposite ends of each of the tracks are fixed bumpers 30 of a suitable resilient material for purposes which will become apparent.

Seat 12 includes a generally rectangular frame including a pair of side rails 32 (one shown in FIG. 1) interconnected at their opposite front and rear ends by the crosspieces 34, 36. The seat frame pieces may be made from wood as shown, and within the frame is mounted any suitable spring construction not shown. Upstanding from the seat frame on opposite sides thereof, are a pair of armrests including the vertical piece 38 (one shown in FIG. 1) and horizontal pieces 40, only a portion of one of which is shown in FIG. 1. The armrest pieces 38, 40 are also made from wood in the specific form shown, and it should be understood that the armrests are rigidly secured to the seat frame 32, 34, 36 to form in effect a one-piece unit. The front vertical pieces 38 of the armrests are recessed rearwardly from the front crosspiece 34 of the seat frame to accommodate the front T-portion of a T-cushion (not shown) which of course rests on the seat between the armrests. The seat and armrest frames are of course suitably upholstered in any conventional fashion. Backrest 14 also includes a rectangular wooden frame comprised of horizontal crosspieces 42 (only one shown in FIG. 1) interconnecting vertical pieces 44 and suitably covered with upholstery (not shown).

Seat 12 is mounted on the base for movement relative thereto by means of a seat linkage including an elongated seat link 50 shown as being fixed to the underside of side rail 32 and being generally coextensive therewith. The seat linkage further includes a front seat mounting link 52 pivoted at 54 to seat link 50; and a rear seat mounting link 56 pivoted at 58 to seat link 50. The lower ends of the seat mounting links 52 and 56 are mounted in tracks 26 and 28 by means of a trolley which includes an elongated trolley link 60 extending in the forward-rearward direction of the chair above and generally parallel to base rail 20. As best shown in FIG. 2, roller 57 associated with the front seat mounting link 52 is mounted for rotation by pin 51 on the forward end section of trolley link 60. The lower end of front seat mounting link 52 is pivotally mounted by pin 55 to the forward end of trolley link 60. The lower end of rear seat mounting link 56 is pivotally mounted at pin 61 to the rear section of trolley link 60, and the rear end of trolley link 60 is mounted in tracks 28 by means of roller 59 which is rotatably mounted to trolley link 60 by pin 53. In effect a four bar linkage is thus formed by seat link 50, front and rear seat mounting links 52, 56, and trolley link 60; the pivots of the four bar linkage being 54, 55, 61 and 58. For lateral stability, the trolley is provided with a cross-brace 64 fixed to an intermediate section of trolley link 60 and extending transversely to the other side of the chair where it is fixed to a similar trolley link (not shown).

Footrest 16 is mounted to the seat by means of a footrest linkage which is best shown in FIG. 2 and includes a pair of generally parallel footrest mounting links 70, 71 mounted to the seat link 50 by pivot pins 72, 73 respectively. The footrest linkage further includes a pair of generally parallel links 74 and 75 pivotally connected at pivots 76 and 77 to the ends of footrest mounting links 70 and 71 respectively. Link 75 is also pivotally connected at pivot 78 at an intermediate section thereof to an intermediate section of footrest mounting link 70. The upper end of link 74 is pivotally connected by pivot 79 to a link 80 while the upper end of link 75 is pivotally connected by pivot 81 to a link 82 whose end is pivotally connected by pivot 83 to a link 84. The latter is pivotally connected by pivot 85 so that links 74 and 84 are generally parallel to each other, and links 80 and 82 are generally parallel to each other. Finally, link 82 has its intermediate section pivotally connected to link 74 at an intermediate section on the latter.

It will thus be seen that the footrest linkage is a "lazy tong" type linkage system. Also it should be noted that the footrest proper (not shown in FIG. 2) is fixed to link 80 which is accordingly flanged to accommodate easy mounting of the footrest frame which is shown at 16 in FIG. 1. Although not shown, a torque bar is provided interconnecting the footrest mounting link 70 on one side of the chair with the corresponding footrest mounting link on the other side of the chair. The torque bar itself is conventional of course and the purpose is to transmit the motion of the footrest from the side which is actuated by the handle 94 to the opposite side of the chair. It is also preferred that stops 130 and 132 be provided on the footrest linkage to positively determine the closed and open positions of the footrest linkage, see FIGS. 1 and 2.

In order to move the chair from the closed, generally upright position shown in FIG. 1 to its TV position shown in FIG. 2, it is necessary to actuate the footrest linkage towards its extended position. The footrest linkage is biased in its closed position by means of a spring biasing mechanism. Referring to FIG. 2, this mechanism includes a tension coil spring 87, having one end suitably anchored at 88 to the side rail 32 of the seat frame and its opposite end 89 connected to an intermediate section of an actuator link 90. The latter is elongated extending generally vertically along the front vertical rail 38 of the armrest frame. The lower end of actuator link 90 is pivotally connected at pivot 91 to the footrest mounting link 70 by means of a bracket link 92 which is fixed to it and projects from footrest mounting link 70. The upper end of actuator link 90 is pivoted at 93 to a handle 94 which is mounted to an upper section of the front vertical rail 38 of the armrest frame by means of a bracket 95. The latter is fixed to and projects rearwardly from the armrest rail and receives a pivot pin 96 which mounts the handle 94 thereto.

In order to actuate the footrest and place the chair in TV position, the chair occupant pivots handle 94 in a clockwise direction (as viewed in FIG. 1) about pivot 96 to lower actuator link 90 which in turn will move the footrest mounting link 70 in the clockwise direction (as viewed in FIGS. 1 and 2) toward the TV position. This will cause the front end of a restraining link 100 to move about pivot 73 which mounts footrest mounting link 71 to the seat link 50. The latter action will free the seat mounting links 52, 56 to move forwardly in a counterclockwise direction (as viewed in FIGS. 1 and 2) from the position shown in FIG. 1 to the position shown in FIG. 2 under the weight of the chair's occupant. As best shown in FIG. 2, restraining link 100 has its forward end pivotally connected at 101 to a small crank portion **71*a* of footrest mounting link 71 projecting beyond the pivot 73 at an angle to link 71. The rear end of restraining link 100 is pivotally connected at 102 to an intermediate section of rear seat mounting link 56**.

Referring to FIG. 1, the backrest 14 is pivotally mounted to the seat by means of a backrest linkage including a backrest link 110 fixed to the vertical rail 44 of the backrest frame. The lower end of backrest link 110 is pivotally mounted at 111 with respect to the seat link by means of a bracket 112 which is rigidly fixed in any suitable manner to the rear section of seat link 50. Bracket 112 has a portion projecting above seat link 50 which portion is pivotally connected to backrest link 110 as described. The backrest linkage further includes a short link 113 pivotally connected at 114 to the backrest link 110 and pivotally connected to the link 115 by a pivot 116. Link 115 in turn is pivotally connected at 117 to the rear of seat link bracket 112. Links 110, 112, 113 and the small cranked portion 115*a* of link 115 thus forms a four bar linkage mounting the backrest to the seat.

In order to provide thrust for moving the chair into the advanced reclining position beyond TV position, link 115 is pivotally connected at 120 to a link 122 which has its lower end pivotally connected at 124 to the base rail 20; the latter having fixed thereto an upstanding bracket 125 receiving pivot 124. When the chair is in the closed upright position shown in FIG. 1, the chair occupant's pressure on the backrest during normal use of the chair will not be sufficient to collapse the thrust linkage 115, 122 and hence, the backrest 14 will remain in fixed position relative to the seat 12. However, when the chair is actuated to the TV position as described above, the thrust linkage 115, 122 will be collapsed into the position shown in FIG. 2. Hence if it is now desired to move the chair to advanced reclining positions, all the occupant need do is to exert back pressure on the backrest 14 which will generate a force through the thrust linkage 115, 122 causing the trolley to move forwardly on its rollers 57, 59 up the tracks 26, 28 as best illustrated in FIG. 3 which shows the fully advanced or full reclining position of the chair. During the latter movement, thrust link 122 will pivot counterclockwise (as viewed in FIG. 3) about pivot 124 to its lowermost position, while the backrest link 110 pivots clockwise (as viewed in FIG. 3) about pivot 111 relative to the seat 12.

To review operation of the chair, and assuming the chair is occupied in the closed or upright position shown in FIG. 1, the chair occupant merely has to pivot the handle 94 upwardly to overcome the bias of the spring 87. This will actuate the footrest mounting link 70 from its fully closed position shown in FIG. 1 towards its open position which in turn will move restraining link 100 to allow the seat mounting links 52, 56 to swing forward to place the chair in TV position with the footrest fully extended as shown in FIG. 2. Note that in the TV position of the chair, the trolley has not moved at all along tracks 26, 28 but that the chair has swung its front end upwardly and its rear end downwardly from the position shown in FIG. 1 to the position shown in FIG. 2. Also note that the backrest 14 has not moved relative to the seat 12, but that the thrust linkage 115, 122 has been collapsed.

Now should it be desired to move into an advanced reclining position, the occupant merely has to apply back pressure to the backrest which will exert a thrust through thrust link 115 causing the seat and its trolley to move forwardly along the tracks 26, 28. During this latter movement, the backrest link 110 and the backrest will swing rearwardly clockwise about pivot 111 relative to the seat causing thrust link 115 to pivot counterclockwise about pivot 120, and thrust link 122 counterclockwise about pivot 124. It should also be noted that although FIG. 3 shows the fully reclined position, the chair and the trolley may be balanced still by the occupant in any position intermediate the TV position of FIG. 2 and the fully reclined position of FIG. 3. If the chair occupant wishes to return to TV position, he merely has to remove pressure from the backrest 14 whereupon the trolley will move rearwardly down the tracks 26, 28 into TV position. If the occupant now wishes to return to the original upright position, he merely applies leg pressure to the footrest to fold the footrest linkage into its retracted position.

Although the linkage and track systems on only one side of the chair have been illustrated in the drawings and described above, it will of course be understood that the chair will have a corresponding linkage on the other side of the chair. These systems are interconnected to act in unison with enhanced stability by virtue of the seat frame, the torque bar (not shown) of the footrest, and the crossbrace 64 of the trolley.

Figure 4:
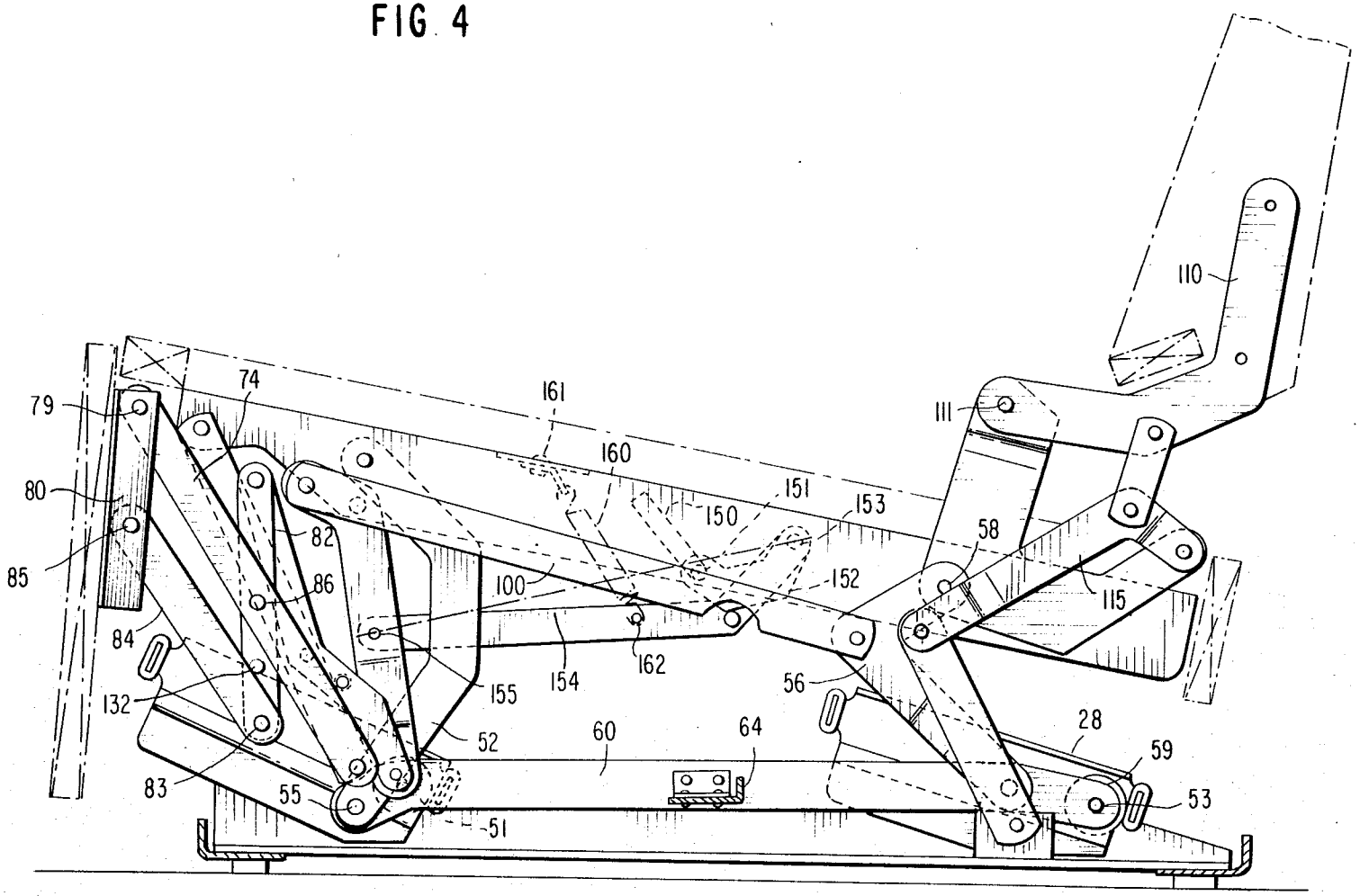
FIGS. 4, 5, 6 and 6A are views generally similar to FIGS. 1, 2, 3 and 3A respectively except the chair disclosed in FIGS. 4, 5, 6 and 6A constitutes a second preferred embodiment of the present invention.
Figure 5:
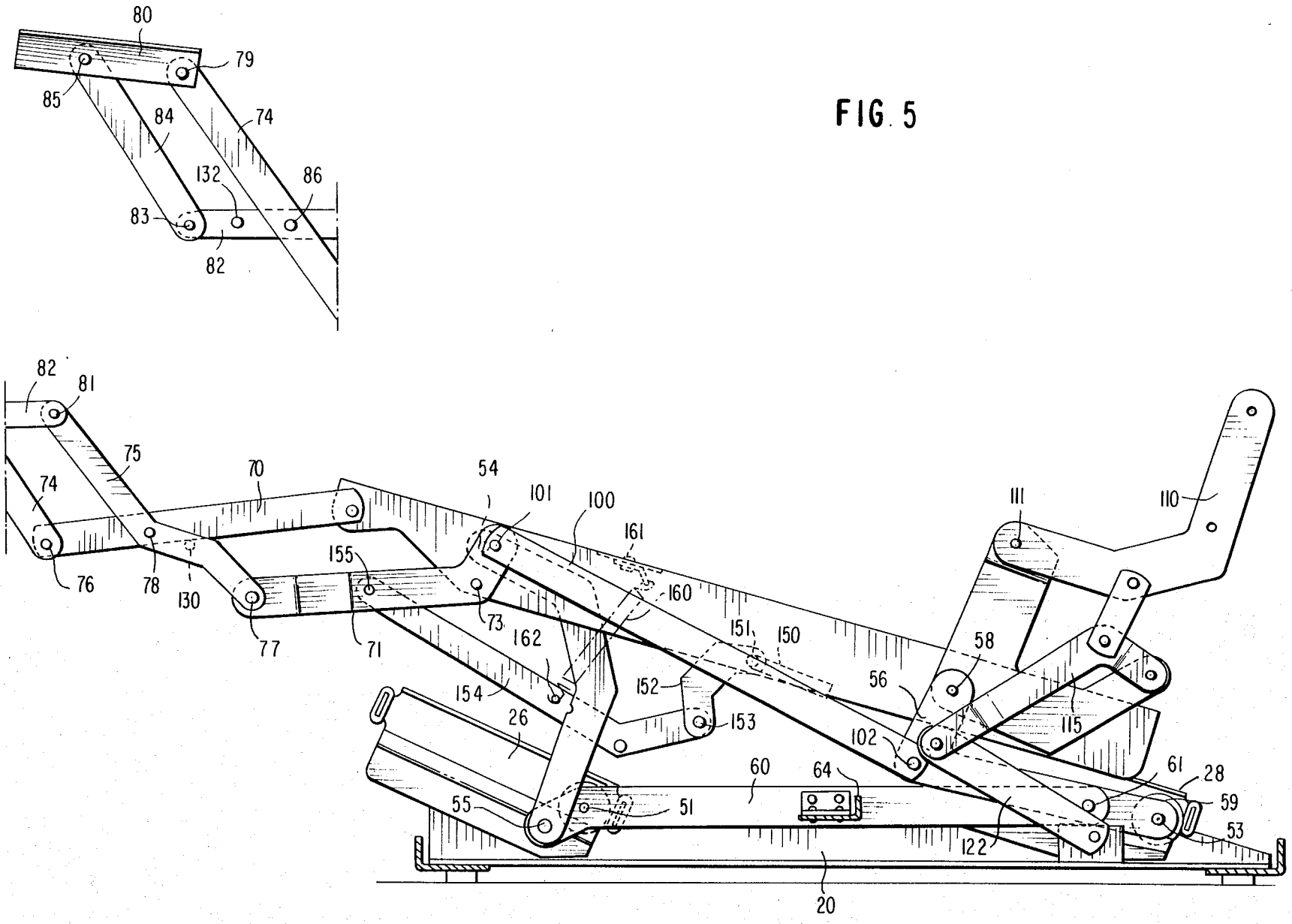
Figure 6:
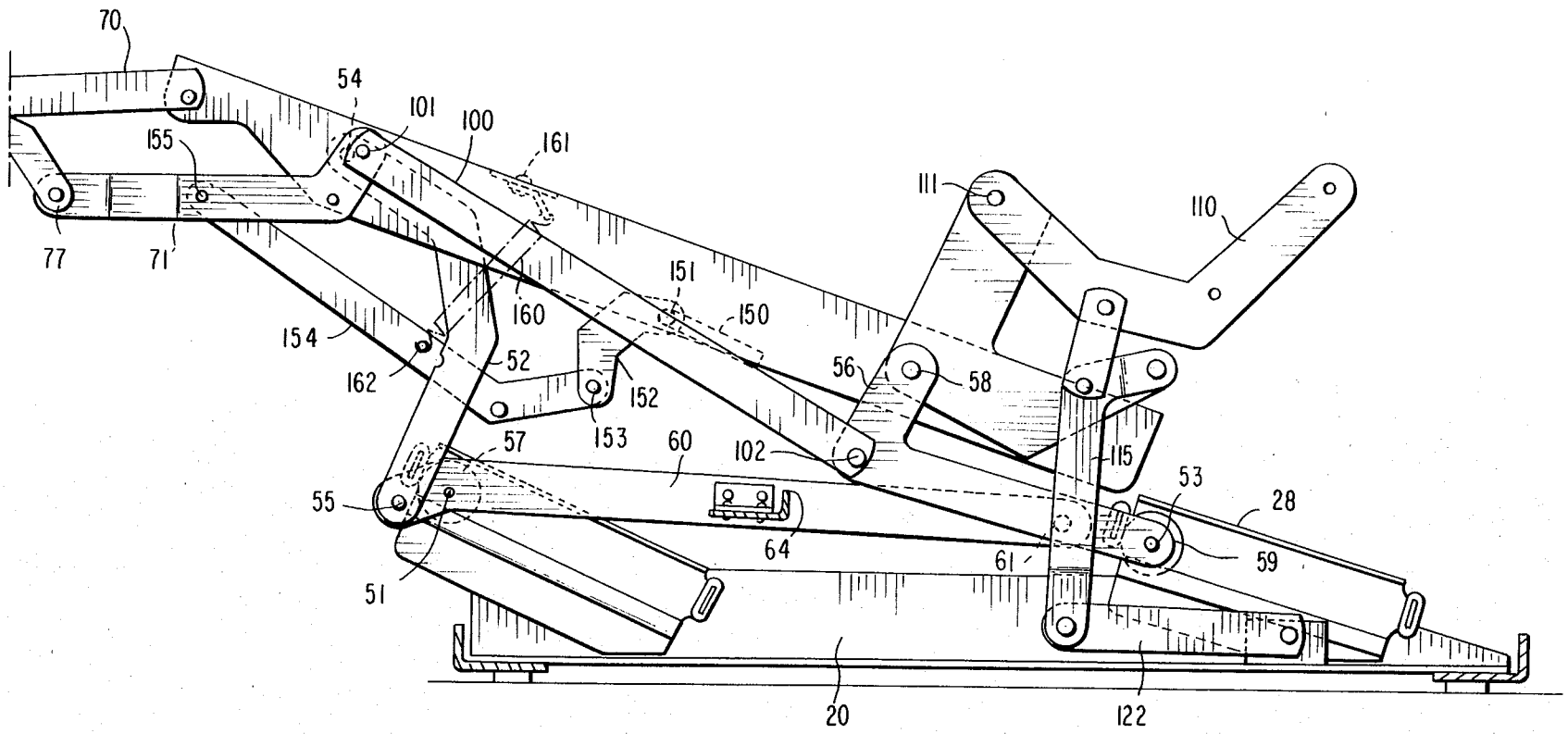
Figure 6A:
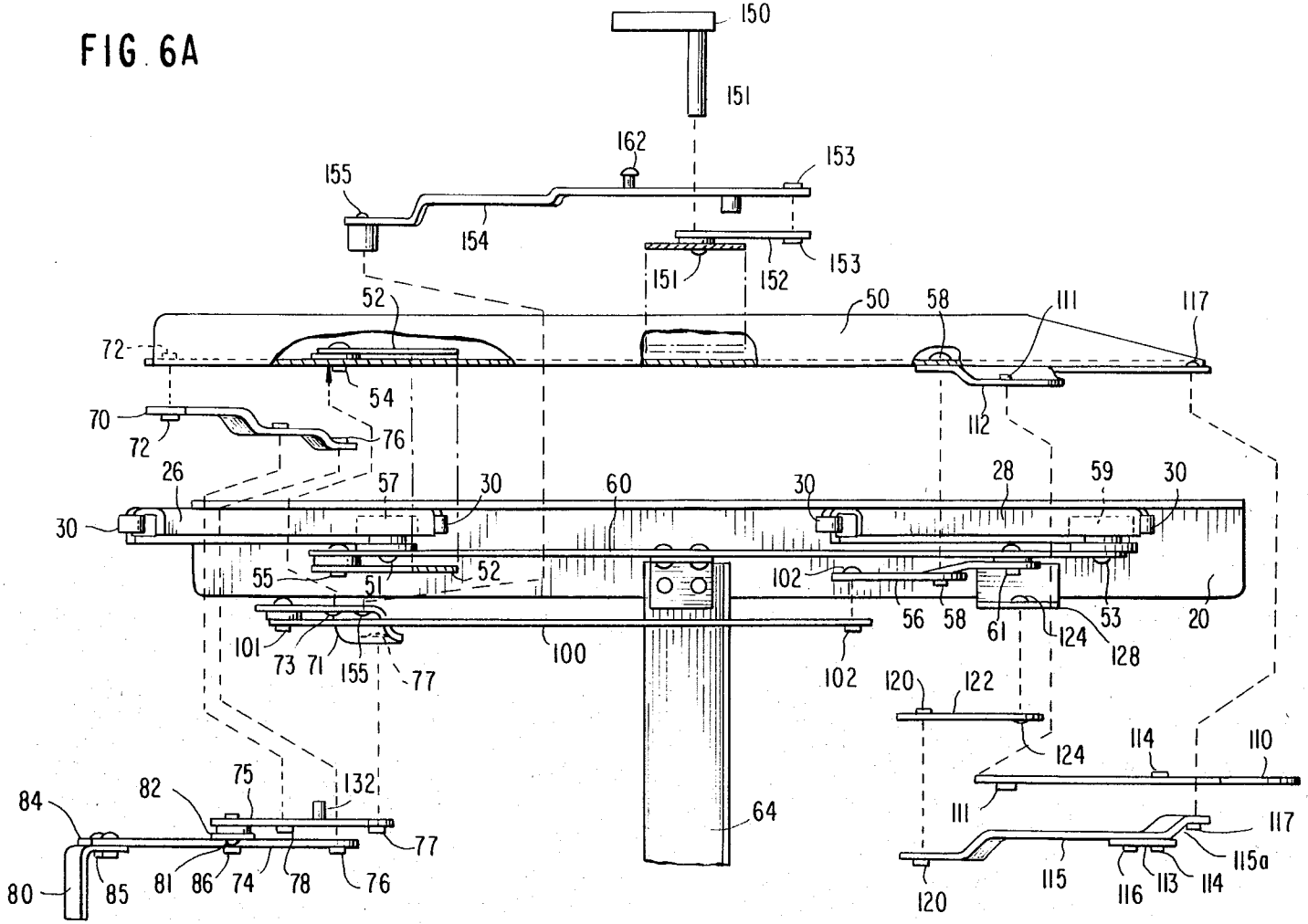

Referring now to FIGS. 4, 5 and 6, there is illustrated a second preferred embodiment of the invention which is the same as that described above with the exception of the actuation means for moving the chair to TV position. In the embodiment of FIGS. 4 to 6, the handle actuator 150 is fixed to a stub shaft 151 which is mounted for rotation in the seat link 50 on one side of the chair. Fixed to shaft 151 is a small link or crank 152 which is pivotally connected at its end by pivot 153 to the end of an actuator link 154. The actuator link 154 is elongated extending forwardly to an intermediate section of footrest mounting link 71 where it is pivotally connected there by pivot pin 155. A tension coil spring 160 is provided to bias the footrest in its closed position. Spring 160 is anchored at one end at 161 to the seat link 50 and has its other end connected at 162 to an intermediate portion of actuator link 154.

In order to move the chair to TV position shown in FIG. 5, the handle 150 is pivoted in a clockwise direction (as viewed in FIG. 4) to overcome the bias of spring 160 and to initially move footrest mounting link 71 in a clockwise direction (as viewed in FIG. 4) until the front end section of restraining link 100 is positioned above pivot 73 of the footrest mounting link 71 whereupon the seat mounting links 52, 56 will be free to move into the TV position with the footrest extended as shown in FIG. 5. The remaining parts and operation of the chair are the same as that described above in connection with the embodiment of FIGS. 1 to 3 and therefore need not be reviewed here.

What is claimed is:

1. A recliner chair comprising in combination, a base, track means fixed on the base, a seat, a trolley mounted in said track means, seat linkage means mounting the seat on the trolley for movement between a normal position, reclined TV position, and an advanced reclined position beyond the TV position, a footrest including a footrest linkage mounting the footrest to the seat for movement between a retracted position adjacent the seat and an extended position projected forwardly from the seat when the seat is in said TV position, means operatively connected between the footrest linkage and the seat linkage means for moving said seat to said TV position by moving the footrest to the extended position while said trolley remains stationary in said track means, and means operatively connected between the seat and the base for moving said trolley along said track means to move said seat from said TV position into advanced reclining position.

2. The recliner chair defined in claim 1 wherein said means for moving said seat to TV position includes an actuator link operatively connected to the footrest linkage, and means for driving the actuator link.

3. The recliner chair defined in claim 2 wherein said means for driving said actuator link includes a handle mounted for pivotal movement on the seat.

4. The recliner chair defined in claim 3 wherein said seat includes a frame, an armrest fixed to the frame and including a vertical portion, and wherein said handle is mounted to said vertical portion of said armrest.

5. The recliner chair defined in claim 3 wherein said seat includes a frame having a side piece and wherein said handle is mounted to said side piece.

6. The recliner chair defined in claim 4 including spring means including a spring connected to said actuator link for biasing the footrest to its retracted position.

7. The recliner chair defined in claim 5 including spring means including a spring connected to said actuator link for biasing the footrest to its retracted position.

8. The recliner chair defined in claim 1 wherein said means for moving said trolley along said track means includes a thrust linkage interconnected between said backrest and said base.

9. The recliner chair defined in claim 8 wherein said thrust linkage includes a first link connected to said backrest, and a second link pivotally connected to said first link and pivotally connected to said base.

10. The recliner chair defined in claim 9 including a backrest linkage mounting the backrest to the seat, said backrest linkage including a backrest link fixed to the backrest and pivotally mounted to said seat, and a link pivotally interconnecting said backrest link and said first of said thrust linkage link.

11. The recliner chair defined in claim 2 wherein said means for moving said trolley along said track means includes a thrust linkage interconnected between said backrest and said base.

12. The recliner chair defined in claim 11 wherein said thrust linkage includes a first link connected to said backrest, and a second link pivotally connected to said first link and pivotally connected to said base.

13. The recliner chair defined in claim 12 including a backrest linkage mounting the backrest to the seat, said backrest linkage including a backrest link fixed to the backrest and pivotally mounted to said seat, and a link pivotally interconnecting said backrest link and said first thrust link.

14. The recliner chair defined in claim 13 wherein said means for driving said actuator link includes a handle mounted for pivotal movement on the seat.

15. The recliner chair defined in claim 14 wherein said seat includes a frame, an armrest fixed to the frame and including a vertical portion, and wherein said handle is mounted to said vertical portion of said armrest.

16. The recliner chair defined in claim 14 wherein said seat includes a frame having a side piece and wherein said handle is mounted to said side piece.

17. The recliner chair defined in claim 15 including spring means including a spring connected to said actuator link for biasing the footrest to its retracted position.

18. The recliner chair defined in claim 16 including spring means including a spring connected to said actuator link for biasing the footrest to its retracted position.

19. The recliner chair defined in claim 11 wherein said seat linkage means includes front and rear seat mounting links each pivotally connected to the seat and the trolley, and wherein there is further included a restraining link pivotally connected to the rear seat mounting link and said footrest linkage for restraining movement of said seat linkage until said footrest linkage is initially moved from its retracted position towards its extended position.

20. The recliner chair defined in claim 19 wherein said thrust linkage includes a first link connected to said backrest, and a second link pivotally connected to said first link and pivotally connected to said base.

21. The recliner chair defined in claim 20 including a backrest linkage mounting the backrest to the seat, said backrest linkage including a backrest link fixed to the backrest and pivotally mounted to said seat, and a link pivotally interconnecting said backrest link and said first thrust link.

22. The recliner chair defined in claim 21 wherein said means for driving said actuator link includes a handle mounted for pivotal movement on the seat.

23. The recliner chair defined in claim 22 wherein said seat includes a frame, an armrest fixed to the frame and including a vertical portion, and wherein said handle is mounted to said vertical portion of said armrest.

24. The recliner chair defined in claim 22 wherein said seat includes a frame having a side piece and wherein said handle is mounted to said side piece.

25. For use in a recliner chair of the type having a base, a seat mounted on the base, a backrest mounted to the seat, and a footrest mounted to the seat for movement between extended and retracted positions; a mechanism for mounting the seat to the base for movement between a generally upright, normal position, a reclined TV position with the footrest extended, and advanced reclining positions beyond the TV position, the mechanism including an elongated seat link adapted to be fixed to the seat along a side of the seat, an elongated trolley link located below the seat link and extending in the same general direction thereof, said trolley link having bearing means on opposite end sections thereto adapted to be received in tracks fixed on the base of an associated chair, a seat linkage mounting the seat link to the trolley link for reclining movement relative thereto from a first position occupied by the seat linkage when the seat is in said generally upright normal position, a footrest linkage mounted to the seat link for movement between extended and retracted positions relative thereto, a restraining link pivotally interconnecting the seat linkage and the footrest linkage to prevent reclining movement of the seat linkage from said first position until the footrest linkage is actuated from its retracted to extended position, actuating means for driving the footrest from its retracted position towards its extended position while said trolley link remains stationary, a backrest linkage pivotally mounted to the seat link for mounting the backrest to the seat, and a thrust linkage pivotally connected to the backrest linkage and to be pivotally mounted to the base of the associated chair for developing a thrust force for moving the trolley link along the associated tracks only after the associated seat has been moved to TV position.

26. The mechanism defined in claim 25 wherein said actuating means includes a handle adapted to be pivotally mounted to the seat of the associated chair, and an actuating link operatively interconnecting the handle and the footrest linkage for actuating the footrest linkage upon pivoting of the handle.

27. The mechanism defined in claim 26 wherein said handle is adapted to be mounted to a vertical portion of an armrest that is fixed to the seat with the actuating link extending generally vertically between the handle and the footrest.

28. The mechanism defined in claim 26 wherein said handle is mounted to said seat link with said actuating link extending generally horizontally between the handle and the footrest linkage.

29. The mechanism defined in claim 27 further including spring means connected to the actuating link for biasing the footrest linkage to its retracted position.

30. The mechanism defined in claim 28 further including spring means connected to the actuating link for biasing the footrest linkage to its retracted position.

31. The mechanism defined in claim 26 further including spring means connected to the actuating link for biasing the footrest linkage to retracted position.

32. The mechanism defined in claim 25 further including spring means for biasing the footrest linkage to its retracted position.

33. The mechanism defined in claim 26 further including a base, tracks mounted on the base to extend generally in the forward-rearward direction of the chair, said trolley link being mounted in said tracks, said thrust linkage being pivotally connected at one end to said base.

34. The mechanism defined in claim 33 wherein said thrust linkage includes a first link pivotally connected to the backrest linkage, a second link pivotally connected to the base, said first and second links of said thrust linkage being pivotally connected to each other such that when the associated seat is in the upright normal position thereof the thrust linkage inhibits movement of the backrest relative to the seat and movement of the trolley along the tracks, and when the seat is in the TV position the thrust linkage allows the backrest to be pivoted relative to the seat while the trolley moves along the tracks.

35. The mechanism defined in claim 34 wherein the backrest linkage includes a backrest link pivotally mounted to the seat link and adapted to be pivotally mounted to the backrest, and a link pivotally interconnecting the backrest link and said first link of the thrust linkage.

36. The mechanism defined in claim 35 wherein said actuat means includes a handle pivotally mounted to the seat, and an actuator link operatively interconnecting said handle and the footrest linkage to drive the footrest linkage upon movement of the handle.

37. The mechanism defined in claim 36 further including spring means connected to the actuator link for biasing the footrest to retracted position.

38. The mechanism defined in claim 37 wherein said handle is mounted to an armrest fixed to the seat, and the spring means is anchored to the seat.

39. The mechanism defined in claim 37 wherein said handle mounted to the seat link, and wherein said spring means is anchored to the seat link.

* * * * *